US009140022B2

(12) United States Patent
Gilbert-Williams

(10) Patent No.: US 9,140,022 B2
(45) Date of Patent: Sep. 22, 2015

(54) SAFETY GUARD RAIL

(76) Inventor: Eric Gilles Gilbert-Williams, Calgary (CA)

( * ) Notice: Subject to any disclaimer, the term of this patent is extended or adjusted under 35 U.S.C. 154(b) by 192 days.

(21) Appl. No.: 13/561,516

(22) Filed: Jul. 30, 2012

(65) Prior Publication Data

US 2014/0027696 A1 Jan. 30, 2014

(51) Int. Cl.

| | |
|---|---|
| ***E04G 3/22*** | (2006.01) |
| ***E04G 5/04*** | (2006.01) |
| ***E04G 21/32*** | (2006.01) |

(52) U.S. Cl.

CPC ..... *E04G 5/041* (2013.01); *E04G 5/043* (2013.01); *E04G 21/3214* (2013.01)

(58) Field of Classification Search

USPC ..... 256/65.14, DIG. 6; 182/45, 113

See application file for complete search history.

(56) References Cited

U.S. PATENT DOCUMENTS

| | | | | |
|---|---|---|---|---|
| 1,917,809 | A | 11/1930 | Reimann | |
| 3,901,481 | A | 8/1975 | Probst | |
| 4,884,775 | A | 12/1989 | Fischer, Jr. | |
| 4,957,185 | A * | 9/1990 | Courchesne et al. | 182/45 |
| 5,067,586 | A | 11/1991 | Myers | |
| 5,377,958 | A * | 1/1995 | Palmer | 256/59 |
| 5,515,941 | A | 5/1996 | Palmer et al. | |
| 5,718,305 | A | 2/1998 | Palmer | |
| 6,053,281 | A * | 4/2000 | Murray | 182/113 |
| 6,336,623 | B1 | 1/2002 | McCarthy | |
| 7,806,232 | B2 | 10/2010 | Thomas et al. | |
| 2002/0109059 | A1 | 8/2002 | Macri et al. | |
| 2006/0054393 | A1 | 3/2006 | Eisenkrein | |

FOREIGN PATENT DOCUMENTS

| | | |
|---|---|---|
| AU | 2009100646 | 8/2009 |
| CA | 2452985 | 6/2005 |
| CA | 2635557 | 12/2009 |
| DE | 86802 | 9/1895 |
| GB | 1462313 | 1/1977 |
| GB | 2243397 | 10/1991 |

OTHER PUBLICATIONS

International Search Report from PCT Application PCT/CA2013/050587 mailed on Oct. 18, 2013.

* cited by examiner

*Primary Examiner* — Michael P Ferguson
(74) *Attorney, Agent, or Firm* — Richard D. Okimaw

(57) ABSTRACT

An apparatus for forming a barrier along a perimeter of a roof being formed of a roof deck and a roof covering comprises an anchor plate having a plurality of fastener bores therethrough. The anchor plate is securable between the roof deck and the roof covering proximate to the perimeter of the roof. The apparatus also comprises an upright extending between top and bottom ends. The upright is pivotally securable to the anchor plate and the top end includes at least one connector for connecting a barrier member thereto. The apparatus further includes a brace extending from the bottom end of the upright to abut against an edge surface of the roof.

13 Claims, 6 Drawing Sheets

SAFETY GUARD RAIL

BACKGROUND OF THE INVENTION

1. Field of Invention

The present invention relates to guard rails in general and in particular to a method and apparatus for forming guard rail around the perimeter of a roof.

2. Description of Related Art

In many industries and fields, workers are required to work at heights which pose a safety risk. In particular, workers on roofs, such as for performing maintenance or roof covering replacements are required to spend large amounts of time on such roofs. Traditionally, houses do not include safety railings or other type of barrier to prevent a person thereon from falling off in the event of a slip or trip. This puts them at significant risk of falls from the roof possibly resulting in significant possible injury. Additionally, many homes have sloped roofs to aid in snow and rain removal therefrom which increases the risk of a fall for a worker thereon.

Conventionally, workers who are required to work on roofs, have been required to wear a harness and rope to prevent them from falling off of a roof should they slip or trip. Disadvantageously, such ropes create additional tripping hazards for the workers on the roofs who must also prevent themselves from tripping on the extra ropes. Such ropes may also be prone to catching or snagging on nails or other roofing materials. This may be particularly so in worksites where the roof is being replaced and therefore the existing roofing material must first be removed exposing many nails or fasteners on the roof surface. Workers may also find such ropes difficult and time consuming to maneuver around the chimneys vent and smoke stacks that often extend from the top of many roofs.

Other solutions have been to provide scaffolding around the edge of the roof. Such scaffolding, however is time consuming to set up and expensive to buy or rent, preventing their widespread use on smaller projects.

Previous attempts to reduce the risk of a worker falling from a roof have been to provide safety rails around the edge of the roof. As such rails are not commonly built into the roof during initial construction, it is necessary to secure the rail through the roofing material when required for such an existing roof. Disadvantageously, such devices may need to be removed in order to access the roofing material thereunder, such as for replacement and or repair. The railing must also then be removed again in order to apply new roofing material to that region. This requirement to have no railing for times when the edge of the roof is being worked on reduces the effectiveness of these railing systems.

SUMMARY OF THE INVENTION

According to a first embodiment of the present invention there is disclosed an apparatus for forming a barrier along a perimeter of a roof being formed of a roof deck and a roof covering. The apparatus comprises an anchor plate having a plurality of fastener bores therethrough. The anchor plate is securable between the roof deck and the roof covering proximate to the perimeter of the roof. The apparatus also comprises an upright extending between top and bottom ends. The upright is pivotally securable to the anchor plate and the top end includes at least one connector for connecting a barrier member thereto. The apparatus further includes a brace extending from the bottom end of the upright to abut against an edge surface of the roof.

The anchor plate and the upright may be hingedly connectable to each other at a pin connection. The pin connection may be located exterior to the perimeter of the roof. The anchor plate and the upright may be selectably connectable to each other.

The brace and the bottom end of the upright may be locatable within a rain gutter extending along the perimeter of the roof. The brace may have an adjustable length. The brace may include a free distal end. The free distal end may include a pad.

The pin connection may be spaced apart from the upright by an arm. The arm may include an upturned distal end.

The apparatus may further include a support leg extending therefrom to a free distal end, the free distal end being located above the roof. The support leg may have an adjustable length. The support leg may extend from the upright at a position above the anchor plate. The support leg may extend diagonally from the upright.

According to a further embodiment of the present invention there is disclosed a system for forming a barrier along a perimeter of a roof being formed of a roof deck and a roof covering. The system comprises a plurality of anchor plates having a plurality of fastener bores therethrough securable between the roof deck and the roof covering proximate to the perimeter of the roof. The system further comprises a plurality of uprights extending between top and bottom ends. Each upright is pivotally securable to an anchor plate and the top end includes at least one connector for connecting a barrier member thereto. The system further comprises a brace extending from the bottom end of the upright to abut against an edge surface of the roof and at least one barrier member connectable to the connectors of the uprights for forming a barrier along the perimeter of the roof.

The barrier member may be formed of wood. The barrier member may be substantially flexible. The barrier member may be selected from the group consisting of rope, chain or cable.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
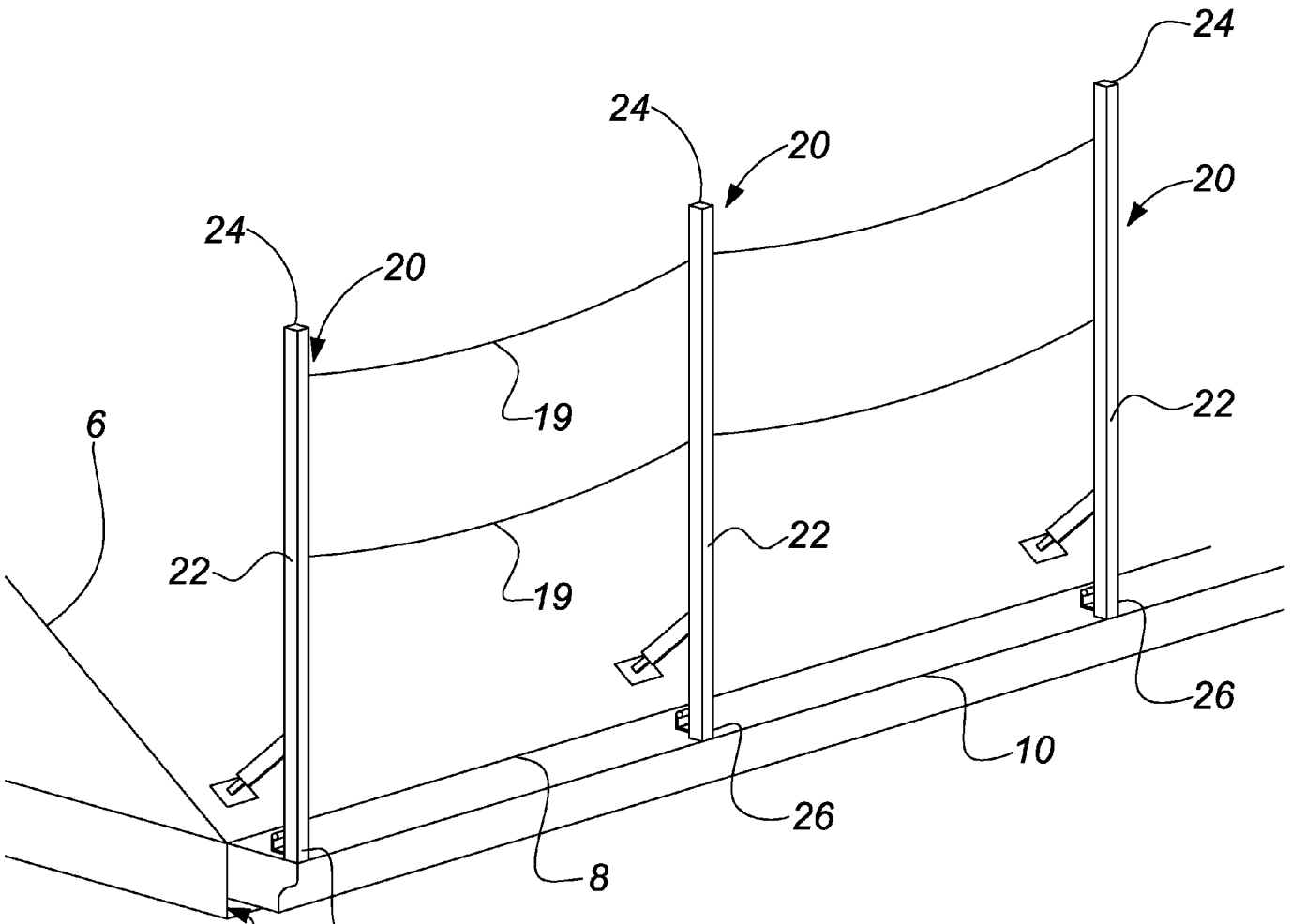
FIG. 1 is a perspective view of a roof having a safety barrier formed therealong.
Figure 2:
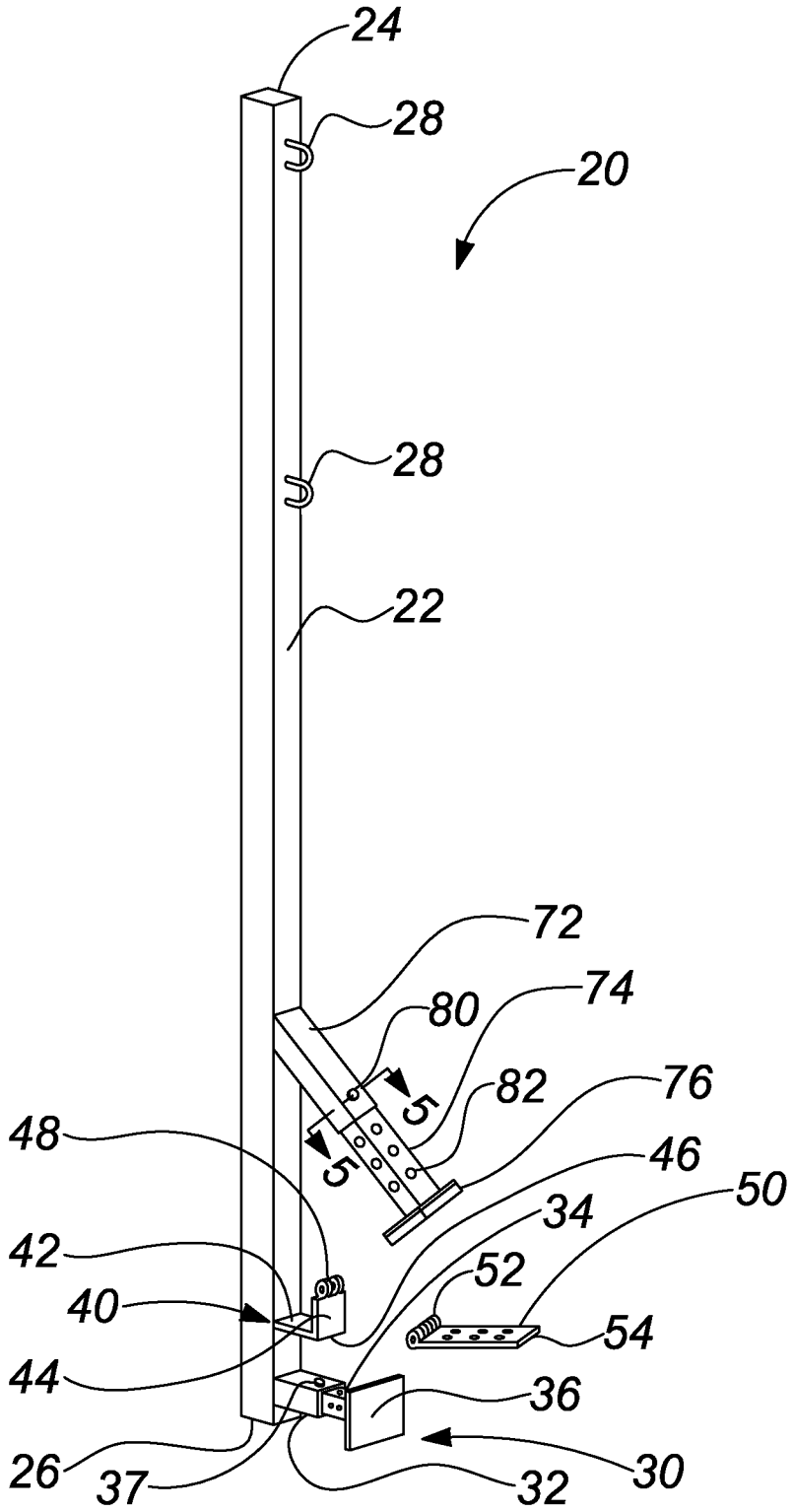
FIG. 2 is a perspective view of an apparatus for forming the barrier of FIG. 1.
Figure 3:
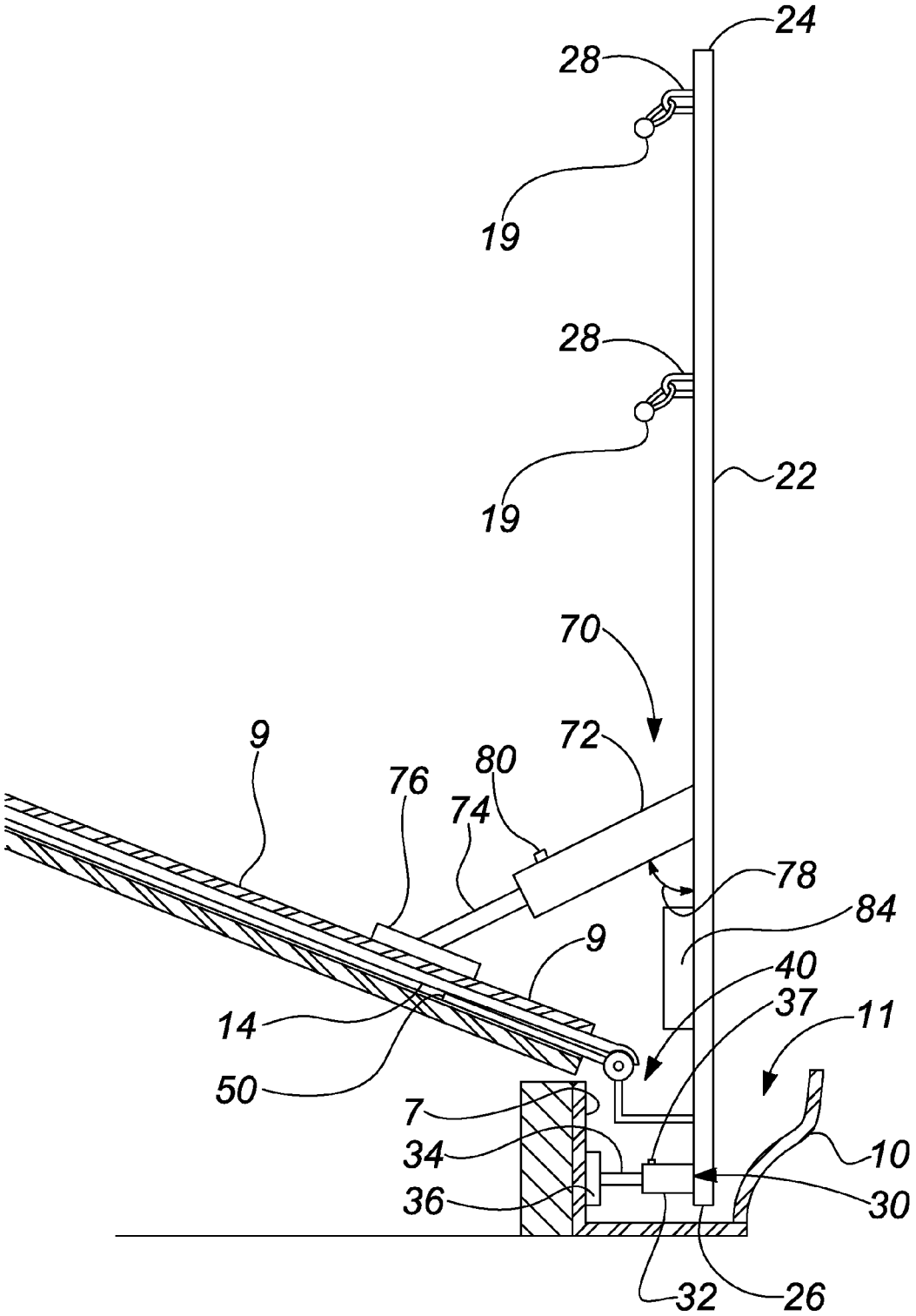
FIG. 3 is a side profile view of one of the apparatus of FIG. 2 applied to a roof.
Figure 4:
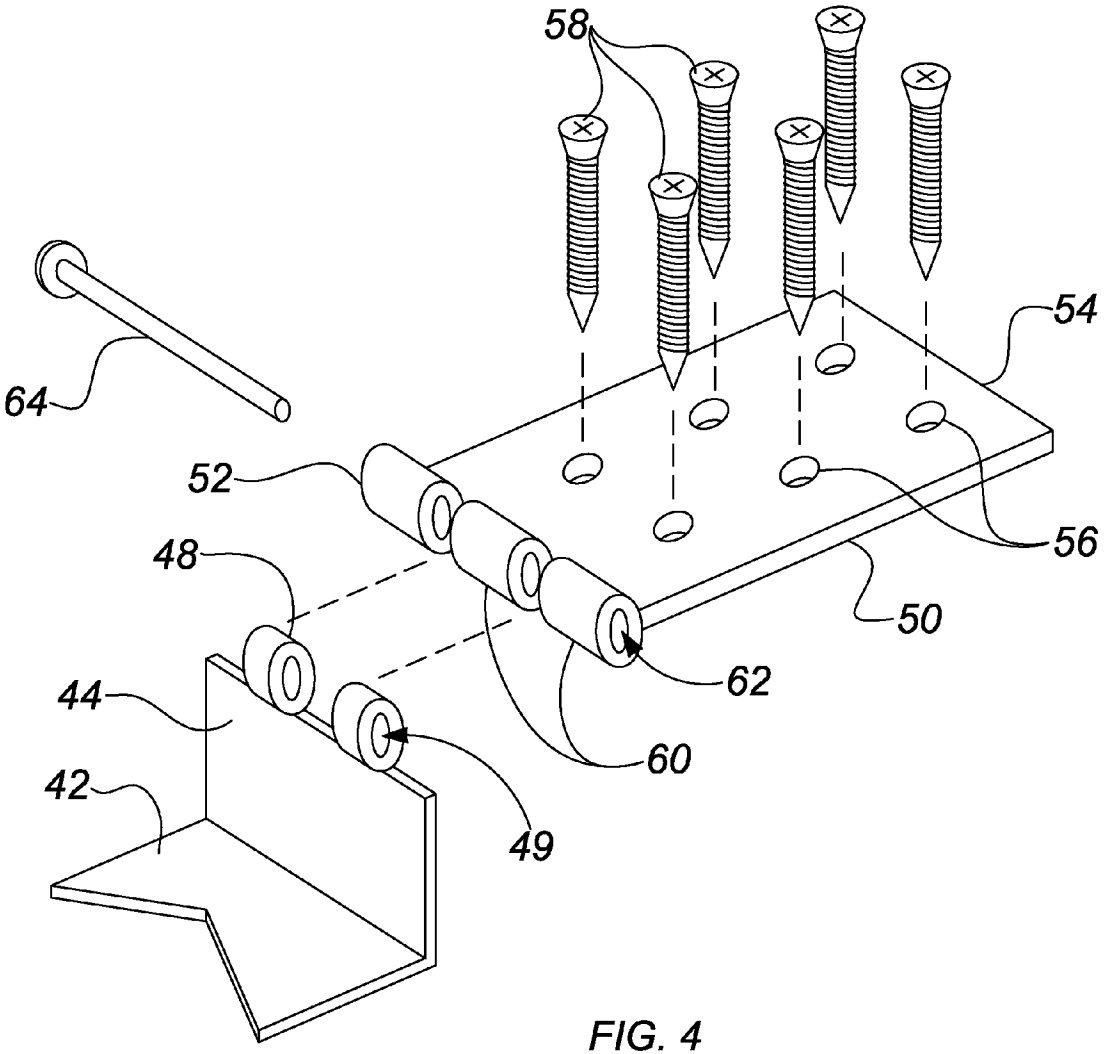
FIG. 4 is a detailed perspective view of the pin connection and anchor plate of FIG. 2.
Figure 5:
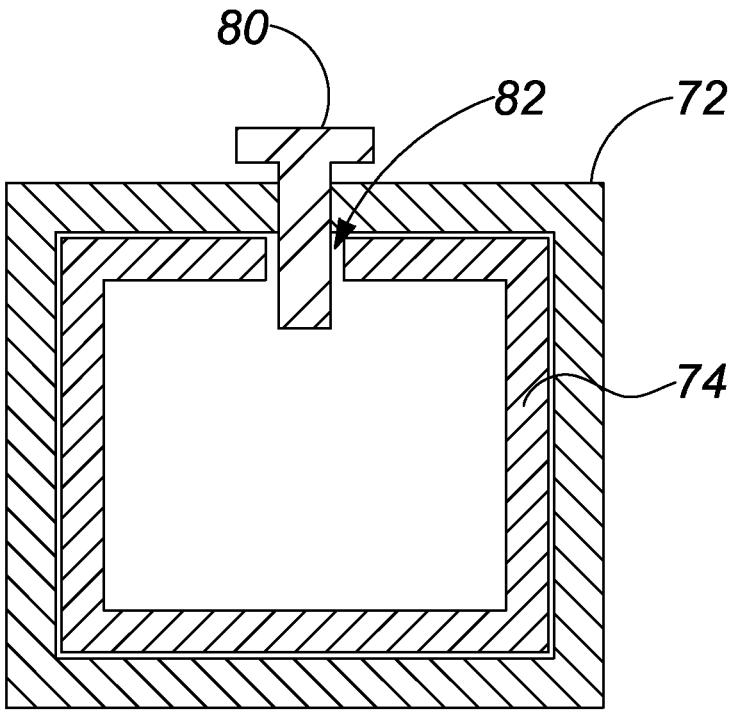
FIG. 5 is a detailed cross sectional view the support of the apparatus of FIG. 2.

Referring to FIGS. 1 through 3, an apparatus for forming a barrier around the perimeter 8 of a roof 6 according to a first embodiment of the invention is shown generally at 20. The roof includes a rain gutter 10 extending from a vertical edge surface 12 of the roof along the perimeter 8. As illustrated, the roof 6 may be sloped, although it will be appreciated that the apparatus of the present disclosure may be applied to horizontal roofs as well. The apparatus comprises an anchor plate 50 (as illustrated in FIGS. 3 and 4), an upright 22 extending between top and bottom ends, 24, and 26, respectively and a brace 30 extending from the bottom end thereof. The bottom end 26 and brace 30 are adapted to be received within the rain gutter 10 as will be further described below. It will also be appreciated that the bottom end and brace 30 may abut against the facia of a roof where the roof does not yet include a rain gutter 10.

The upright 22 comprises an elongate substantially straight member. Although the upright is illustrated as having a substantially square cross-section, it will be appreciated that any other cross-section profile will be useful as well, such as, by way of non-limiting example, circular, oval irregular, I-beam or c-channel. It will also be appreciated that the upright may be solid or hollow as required by the strength requirements of the application. The upright may be formed of any suitable material, such as, metal, plastics, wood or composite materials having sufficient strength. The upright includes one or more connectors 28 for receiving a flexible barrier 19, such as, by way of non-limiting example, a rope, chain, cable or other member for forming a fence. As illustrated one of the connectors 28 may be located proximate to the top end 24 of the upright 22 while a second connector 28 may be spaced vertically apart therefrom as illustrated in FIG. 2. Although two connectors are illustrated, it will also be appreciated that other quantities may also be utilized, such as, 1, 3, 4 or more as well. The two connectors may be located so as to support the flexible barrier 19 at any heights desired by a user, such as, by way of non-limiting example, between 6 and 84 inches (152 and 2133 mm). The upright has a length sufficient to provide the connectors 28 at the desired heights, such as between 24 and 48 inches (610 and 1219 mm). As illustrated, the connectors 28 may comprise loops although it will be appreciated that other structures adapted to receive and support flexible barrier members will also be useful as well.

The apparatus further includes a brace 30 extending from the bottom end 26 of the upright as set out above. The brace 30 comprises a first sleeve 32 extending from the upright 22 and an insert 34 slidably received therein. The insert 34 and first sleeve 32 may include an end plate 36 thereon having padding or the like applied thereto. The first sleeve may include a threaded bore having a fastener 37 threadably located therein. The insert may have a plurality of bores 38 located therealong, sized and located to be selectably engaged by the fastener 37 so as to permit the length of the brace 30 to be adjusted. The length of the brace 30 may be adjustable to any length desired by a user, such as, by way of non-limiting example up to 3 inches (76 mm). The first sleeve 32 and insert 34 may be formed of any suitable material so as to provide sufficient strength to retain the upright in a substantially vertical orientation.

Figure 6:
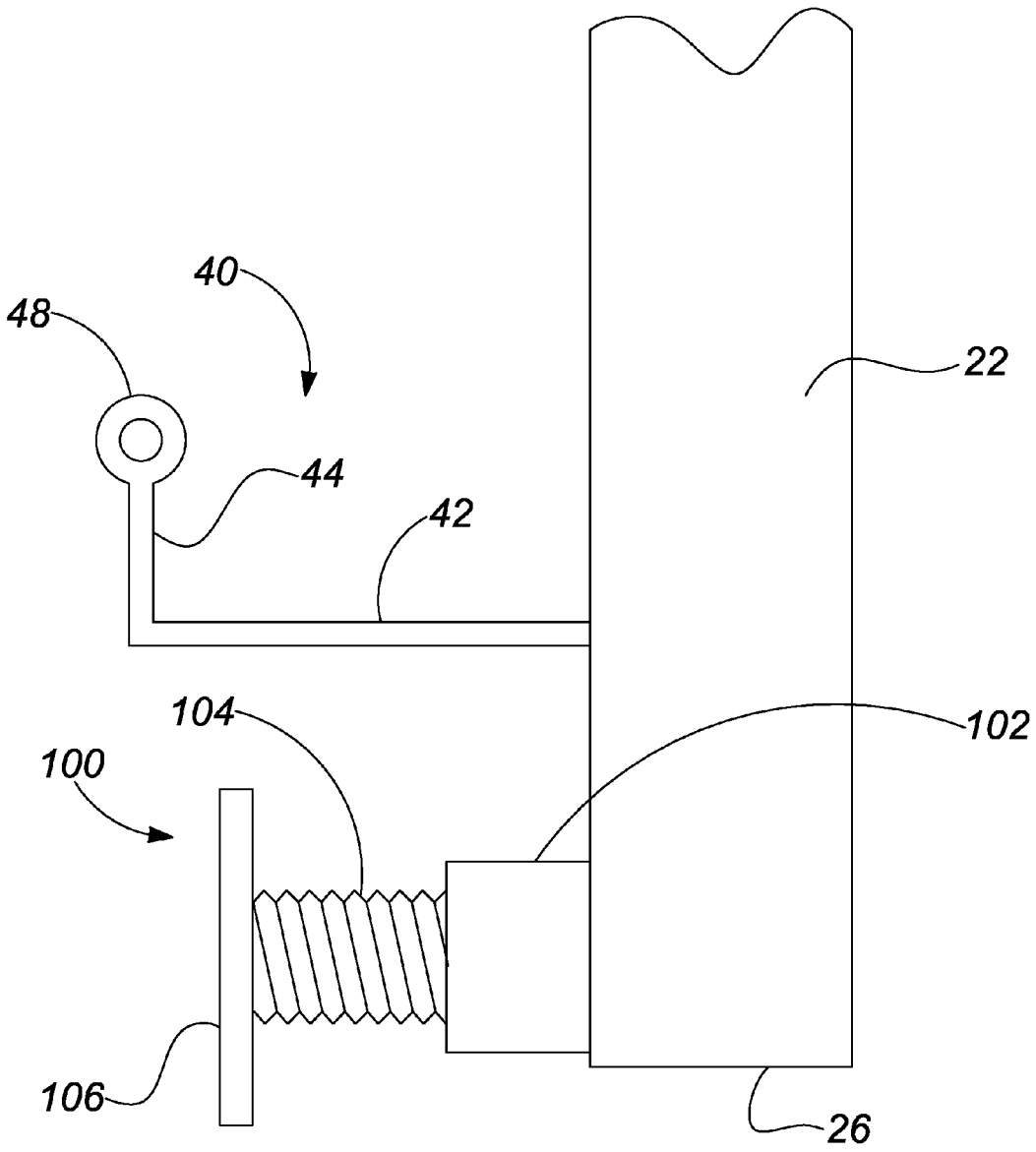
FIG. 6 is a detailed side view the support of the apparatus of FIG. 2 according to an alternative embodiment of the present invention.

With reference to FIG. 6, an alternative embodiment of the present apparatus is illustrated having a threaded brace 100. The threaded brace comprises a threaded sleeve 102 extending from the upright 22 proximate to the bottom end 26 thereof. A threaded rod 104 is threadably received within the sleeve 102 such that the rod 104 and sleeve 102 will have an adjustable length by rotating the rod 104 relative to the sleeve 102. The threaded rod 104 includes a pad 106 at a free distal end thereof for abutting against an edge of the roof.

The upright 22 further includes a connector arm 40 extending therefrom at a location proximate to the brace 30. The connector arm 40 arm comprises a first substantially horizontal member 42 extending substantially perpendicularly from the upright 22 and a second substantially vertical member 44 extending substantially vertically from a distal end 46 of the horizontal member. As illustrated, the vertical member 44 has at least one loop 48 having a common bore 49 extending therethrough for hinged connection with a corresponding loop 60 of the anchor plate 50 as illustrated in FIG. 4 and more fully described below.

The anchor plate 50 comprises a substantially planar member extending between first and second ends, 52 and 54, respectively and having a plurality of bores 56 therethrough. Fasteners 58, such as, by way of non-limiting example screws or nails may be passed through the bores 56 to secure the anchor plate to the roof surface. As illustrated in FIG. 3, the anchor plate 50 may be secured to the roof 6 with fasteners 58 and a roofing material, such as, by way of non-limiting example shingles 9 applied thereover. It will therefore be appreciated that the anchor plate 50 will permanently remain in place on the roof when the uprights are not used. The first end 52 anchor plate 50 includes at least one loop 60 having a common bore 60 therethrough. As illustrated in FIG. 4, the loops 48 of the connector arm 40 and the loops 60 of the anchor plate 50 are adapted to intermesh with each other such that a pin 64 may be passed through the bores 49 and 62. The anchor plate may be formed of any suitably strong material, such as, by way of non-limiting example, steel, stainless steel or the like.

Optionally, the upright may include a support leg 70 extending therefrom in a generally downward diagonal direction to abut against the roof 6. The support leg 70 comprises a second sleeve 72 angularly extending from the upright 22 and an insert 74 slidably received therein. The insert 74 may include an end plate 76 thereon having padding or the like applied thereto. As illustrated in FIG. 3, the support leg may extend angularly downward from the insert by an angle generally indicated at 78. The angle may be selected to be between 30 and 60 degrees although it will be appreciated that other angles may be useful as well. The end plate 76 may be secured to the insert 74 at an angle such that the pad will lie flat against a roof surface as illustrated in FIG. 3. Optionally, the pad may be pivotally connected to the insert so as to be adaptable to roofs of varying angles. The second sleeve 72 may include a threaded bore having a fastener 80 threadably located therein. The insert may have a plurality of bores 82 located therealong, sized and located to be selectably engaged by the fastener 80 so as to permit the length of the support leg 70 to be adjusted. The length of the support leg 70 may be adjustable to any length desired by a user, such as, by way of non-limiting example between up to 20 inches (508 mm). The second sleeve 72 and insert 74 may be formed of any suitable material so as to provide sufficient strength to retain the upright in a substantially vertical orientation. It will also be appreciated that other similar support legs having members slidably received within a sleeve and secured thereto by one or more pins or fasteners may also be utilized as well.

In operation, one or more anchor plates 50 may be secured to a roof with fasteners 58. After being secured to the roof, the shingles 9 and optionally a drip edge 14 as are commonly known in the art may be placed over the roof in a conventional manner. When a user needs a barrier around the edge of the roof, the bottom end 26 of the upright may be placed within the opening 11 of a rain gutter 10 with the end plate 36 of the brace 30 engaged against an edge surface 7 of the rain gutter against the edge of the roof. The loops 60 of the anchor may then be intermeshed with the loops 48 of the connector arm 40 so as to align the bores 62 and 49 and a pin inserted therethrough so as to pivotally support the upright 22 from the anchor plate 50. Thereafter, the length of the support leg 70 may be adjusted to place the end plate 76 into contact with the roof and the flexible barriers 19 secured to the connectors. Optionally a kick plate 84, such as, by way of non-limiting example a board may be secured to the uprights as are commonly known in the art.

While specific embodiments of the invention have been described and illustrated, such embodiments should be considered illustrative of the invention only and not as limiting the invention as construed in accordance with the accompanying claims.

What is claimed is:

1. An apparatus for forming a barrier along a perimeter of a roof being formed of a roof deck and a roof covering, the apparatus comprising:

an anchor plate having a plurality of closed fastener bores therethrough said anchor plate being permanently securable between said roof deck and said roof covering proximate to said perimeter;

an upright extending between top and bottom ends, said top end including at least one connector for connecting a barrier member thereto;

an arm extending from said upright, said arm comprising a horizontal member extending from said upright and a vertical member extending upwardly from a distal end of said horizontal member, said vertical member having a pivot connection at a top end thereof spaced apart from said upright so as to form a void between said pivot connection and said upright adapted to receive a drip edge of the roof therein;

a selectably removable pin adapted to selectably connect said anchor plate and said pivot connection to each other to permit removal of said upright while permitting said anchor plate to remain permanently secured to said roof; and a brace extending from said bottom end of said upright to abut against an edge surface of said roof, wherein said brace and said bottom end of said upright are locatable within a rain gutter extending along said perimeter of said roof, wherein said brace is secured to said upright at a position spaced below a position at which said arm is secured to said upright.

2. The apparatus of claim 1 wherein said pin connection is locatable exterior to said perimeter of said roof.

3. The apparatus of claim 1 wherein said brace has an adjustable length.

4. The apparatus of claim 3 wherein said brace includes a free distal end.

5. The apparatus of claim 4 wherein said free distal end includes a pad.

6. The apparatus of claim 1 further including a support leg extending therefrom to a free distal end, said free distal end being locatable above said roof.

7. The apparatus of claim 6 wherein said support leg has an adjustable length.

8. The apparatus of claim 6 wherein said support leg extends from said upright at a position above said anchor plate.

9. The apparatus of claim 8 wherein said support leg extends diagonally from said upright.

10. A system for forming a barrier along a perimeter of a roof being formed of a roof deck and a roof covering, the system comprising:

a plurality of anchor plates having a plurality of closed fastener bores therethrough said anchor plates being permanently securable between the roof deck and the roof covering proximate to the perimeter of the roof;

a plurality of uprights extending between top and bottom ends, said top end of each said upright including at least one connector for connecting a barrier member thereto;

an arm extending from each said upright, said arm comprising a horizontal member extending from said upright and a vertical member extending upwardly from a distal end of said horizontal member, said vertical member having a pivot connection at a top end thereof spaced apart from said upright so as to form a void between said pivot connection and said upright adapted to receive a drip edge of the roof therein;

a selectably removable pin adapted to selectably connect each said anchor plate and said pivot connection to each other to permit removal of said upright while permitting said anchor plate to remain permanently secured to said roof; and a brace extending from said bottom end of each said upright to abut against an edge surface of the roof, wherein said brace and said bottom end of said upright are locatable within a rain gutter extending along said perimeter of said roof, wherein said brace is secured to said upright at a position spaced below a position at which said arm is secured to said upright; and at least one barrier member connectable to said connectors of said uprights for forming a barrier along the perimeter of the roof.

11. The system of claim 10 wherein said barrier member is formed of wood.

12. The system of claim 10 wherein said barrier member is substantially flexible.

13. The system of claim 12 wherein said barrier member is selected from the group consisting of rope, chain or cable.

* * * * *